US006308736B1

(12) United States Patent
Lafer et al.

(10) Patent No.: US 6,308,736 B1
(45) Date of Patent: Oct. 30, 2001

(54) TUBE-TO-VESSEL CONNECTION USING A FASTENING VALVE

(75) Inventors: Larry Lafer, Plymouth; Robert J. Slais, West Bloomfield, both of MI (US)

(73) Assignee: Automotive Fluid Systems, Inc., Troy, MI (US)

( * ) Notice: Subject to any disclaimer, the term of this patent is extended or adjusted under 35 U.S.C. 154(b) by 0 days.

(21) Appl. No.: 09/346,066

(22) Filed: Jul. 1, 1999

(51) Int. Cl.[7] ..... E03B 11/00

(52) U.S. Cl. ..... 137/590; 137/377; 137/592; 62/509

(58) Field of Search ..... 137/500, 592, 137/377; 62/509

(56) References Cited

U.S. PATENT DOCUMENTS

| | | | | |
|---|---|---|---|---|
| 1,050,181 | * | 1/1913 | Turner | 137/590 |
| 2,600,521 | * | 6/1952 | Swisher | 137/992 |
| 2,967,666 | * | 1/1961 | Carlson | 137/592 |
| 4,700,756 | | 10/1987 | Minard | 141/284 |
| 4,707,999 | | 11/1987 | Ohta et al. | 62/474 |
| 4,878,696 | | 11/1989 | Walker | 285/158 |
| 4,920,766 | | 5/1990 | Yamamoto et al. | 285/137.1 |
| 4,993,455 | * | 2/1991 | Yanagisawa | 137/592 |
| 5,071,172 | | 12/1991 | Gross | 285/189 |
| 5,072,710 | | 12/1991 | Washizu . | |
| 5,209,440 | | 5/1993 | Walker | 285/137.1 |

* cited by examiner

*Primary Examiner*—A. Michael Chambers
(74) *Attorney, Agent, or Firm*—Vanophem & Vanophem, P.C.

(57) ABSTRACT

A pressure vessel including a mounting block for supporting and retaining an inlet and an outlet tube to the pressure vessel. The mounting block includes a valve that communicates with an interior of the vessel and fastens the mounting block to a top of the pressure vessel. The mounting block enables access to the interior of the housing for accessories such as the valve, a sight glass, or a pressure switch, and the accessories can be either permanently or removably attached to the pressure vessel at the top or sides thereof. The mounting block may accommodate more than one valve.

13 Claims, 5 Drawing Sheets

FIG-5
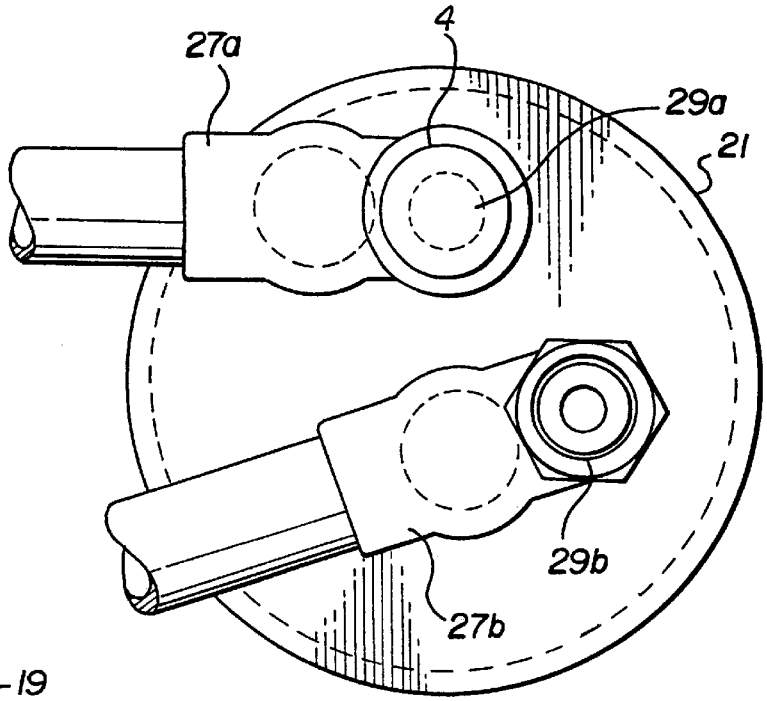
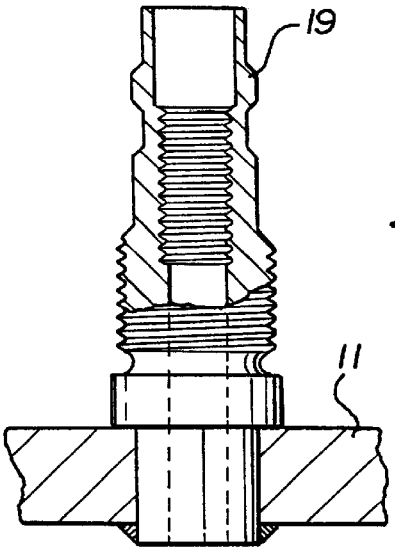
FIG-4
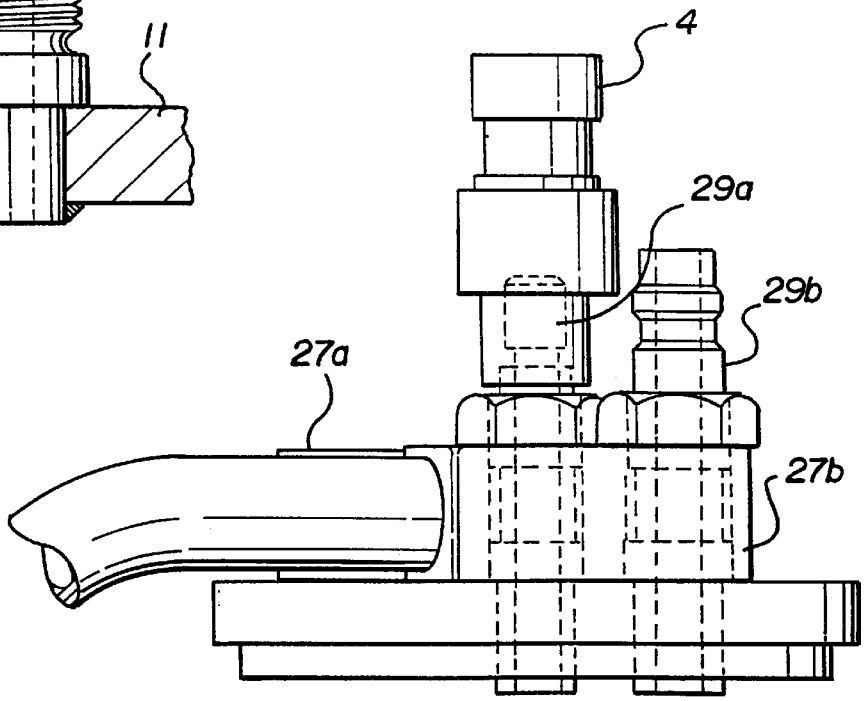
FIG-6

TUBE-TO-VESSEL CONNECTION USING A FASTENING VALVE

BACKGROUND OF THE INVENTION

1. Field of the Invention

The present invention relates to pressure vessels and fixing a tube thereto. More particularly, the present invention relates to fixing a tube to a pressure vessel used in an air-conditioning system, such as an accumulator or receiver.

2. Description of the Prior Art

Presently known in the art of tubular connections to a pressure vessel is a mounting block or block joint. Prior art mounting blocks support one or more tubes and facilitate connecting the tubes to the pressure vessel. Prior art mounting blocks are typically attached to a top of the pressure vessel by bolts or screws. This prior art method is unnecessarily complicated and costly for connecting tubes to a pressure vessel.

In contrast, a more simplified prior art method is disclosed in U.S. Pat. No. 4,707,999 awarded to Ohta et al. Ohta et al. attempt to simplify the mounting block connection method by incorporating a block joint on a receiver housing that has inlet and outlet tubes detachably connected thereto. Accordingly, Ohta et al. disclose a receiver housing having a flat top with the block joint connected to an upper surface thereto. The block joint has an opening on one surface for receiving a tube and a protrusion on the opposite surface for insertion into an opening at the top of the receiver housing. Ohta et al. further disclose two methods of connecting the block joint to the top of the receiver housing. One method provides a screw socket into which a fixing bolt is screwed, securing the block joint to the receiver housing. An alternative method provides a bolt having a lock nut. The combination of the bolt and the lock nut fix the block joint to the top of the housing.

In addition, to attach accessories such as pressure switches and sight glasses to the receiver housing, Ohta et al. disclose a modified block joint and multiple block joints. The modified block joint and the multiple block joints are fixed to the top of the receiver housing in the same manner as described above, by a bolt and lock nut arrangement. A pressure switch or sight glass must communicate directly with the interior of the pressure vessel. Therefore, in prior art block joint arrangements like the one disclosed in Ohta et al., access openings to the interior of the vessel are required in addition to the openings for the inlet and outlet tubes.

Such sight glass and pressure switch accessories are desirable features of an air-conditioning system for troubleshooting and maintaining the system. However, the modified block joint and multiple block joints disclosed by Ohta et al. are very costly and add unwanted complexity to the air-conditioning system because of the additional access openings required for communication with the pressure vessel and the additional mounting blocks required for maintaining the accessory connections.

An alternative to the above-described mounting block is a fluid direction tube and bracket assembly as disclosed in U.S. Pat. No. 5,071,172 to Gross. Gross discloses a flexible bracket having a plurality of fluid direction tubes. The entire assembly must be made of a flexible material such as thermoplastic or glass reinforced polymer resin to achieve the necessary flexing and bending required of the bracket for proper assembly. Gross further discloses a chamfered receiving bore that receives a matching chamfer on the bracket assembly. Flexing and stretching the bracket is necessary to ensure proper alignment between the fluid direction tubes and the receiving bores, and an airtight pressure fit holds the bracket assembly in the receiving bores.

The assembly disclosed above in Gross is directed to an automobile engine body or part thereof. It is questionable whether the pressure fit could withstand the excessive pressure an accumulator is exposed to. Also, the tubular connections must accommodate the harsh environment and excessive pressures of the liquid refrigerant and it is not likely that a flexible thermoplastic resin could withstand exposure to such a harsh environment.

Another alternative in U.S. Pat. No. 5,072,710 to Washizu discloses a fuel delivery rail assembly for supplying fuel to a plurality of fuel injectors in an engine. The assembly disclosed in Washizu is an elongated conduit having a rectangular cross section and a plurality of tubular sockets. The conduit and each tubular socket are connected by deforming an annular extension of the tubular socket about a wall opening of the conduit, or by deforming an annular projection from the wall opening in the conduit about an internal shoulder in the tubular socket. A seal member is disposed between the surface of the conduit and the socket to prevent fuel leaks.

Accordingly, the conduit and socket assembly disclosed in Washizu is such that the sockets are permanently attached to the conduit and the upper side of the socket is adapted to receive a tip of a fuel injector only. The conduit wall must have a flat surface for seating the socket on the wall and maintaining the sealing effect of the seal member. The socket disclosed in Washizu is not capable of connecting any other device other than a fuel injector and does not have the capability of mounting or maintaining tubular connections other than the socket itself.

Therefore, what is needed is a simple reliable means to connect tubes to a pressure vessel and at the same time accommodate accessories, such as valves, pressure switches, or sight glasses, without excessive modifications, multiple parts, or unnecessary complexity.

SUMMARY OF THE INVENTION

The pressure vessel of the present invention includes a minimum of parts and simplifies the manufacture of pressure vessels according to known designs. In general, the present invention involves a pressure vessel including a mounting block for supporting and retaining inlet and outlet tubes through a top and into an interior of the pressure vessel. Additionally, a valve or other accessory fastens the mounting block to the top of the pressure vessel and also communicates with the interior of the pressure vessel.

More specifically, in the present invention the valve has an externally threaded stem and is attached to the top, or side of the pressure vessel housing. The valve can be either permanently or removably attached to the housing. Further, a mounting block has passages for retaining the tubes to the pressure vessel as is known in the art. However, the mounting block of the present invention has an additional passage for receiving the valve, a pressure switch, a sight glass, a charging device, or other such accessory. A nut spins over the threaded valve stem and securely engages the mounting block to the top of the pressure vessel housing.

Moreover, more than one valve can be accommodated by the mounting block of the present invention. The valve or valves can be permanently attached to the top of the housing by welding or brazing. It is also possible to machine the valve as part of the top. Alternatively, a threaded valve can be received in a threaded opening in the top of the housing, resulting in a removably attached valve. The threaded connection may be sealed using O-rings or the like.

Accordingly, it is an object of the present invention to reduce the weight and cost of known pressure vessels by simplifying the pressure vessel through combination and elimination of tube mounting hardware.

It is another object of the present invention to reduce the number of braze joints and thereby reduce manufacturing costs and improve product quality. Braze joints are subject to leaks, and elimination of the braze joints improves the quality of the product by reducing the potential for such leaks.

It is yet another object of the present invention to provide a through path to the interior of the vessel through a valve or other device mounted to the pressure vessel. The valve also functions as a fastener for a mounting block for the inlet and outlet tubes.

These objects, features, and advantages of the present invention will become readily apparent from the following detailed description of the preferred embodiment when taken in connection with the accompanying drawings.

BRIEF DESCRIPTION OF THE DRAWINGS

FIG. 4 is a cross-sectional view of the top and valve;

FIG. 5 is a plan view of another embodiment of the top of the present invention having multiple valves, one valve having a pressure switch attached;

FIG. 6 is a side view of the embodiment of FIG. 5;

DETAILED DESCRIPTION OF THE PREFERRED EMBODIMENT

Figure 1:
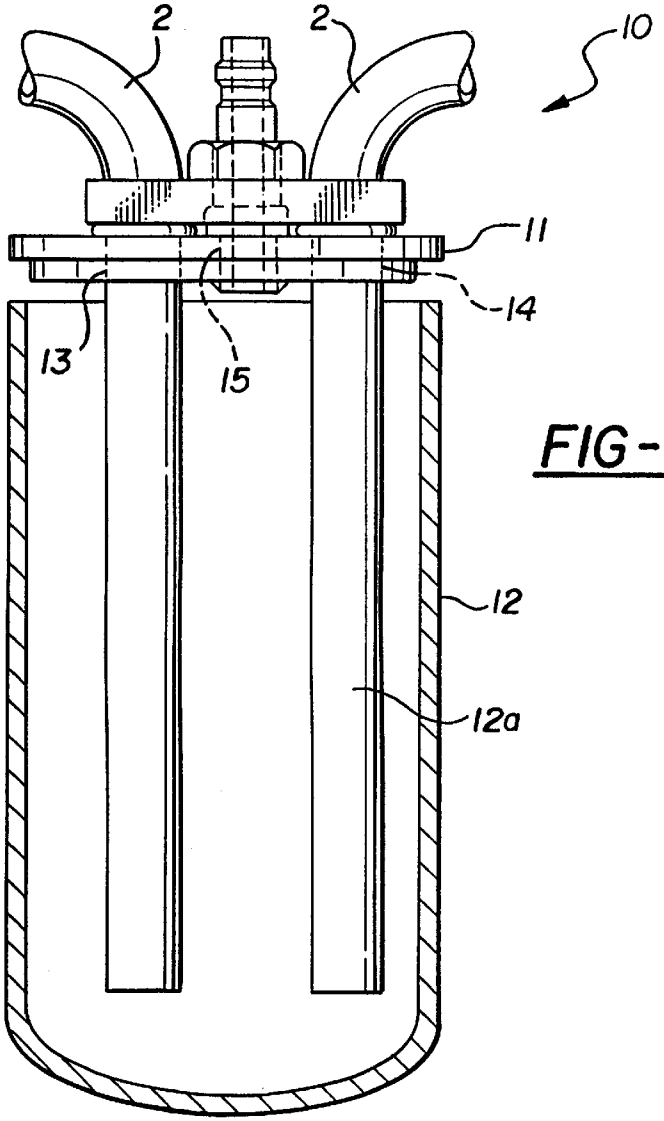
FIG. 1 is an elevational, exploded view shown in partial cross section of a pressure vessel of the present invention.

A first embodiment of a pressure vessel 10 constructed in accordance with the present invention is shown in FIG. 1, wherein the pressure vessel 10 has a housing 12 and a top 11 that securely engages to the housing 12. For purposes of illustration, FIG. 1 is an exploded view of the housing 12 and the top I 1. The top 1 1 has an inlet hole 13, an outlet hole 14, and a mounting hole 15. The inlet and outlet holes 13 and 14 receive tubes 2 that extend into an interior 1 2a of the housing 12 as in a conventional accumulator assembly.

Figure 2:
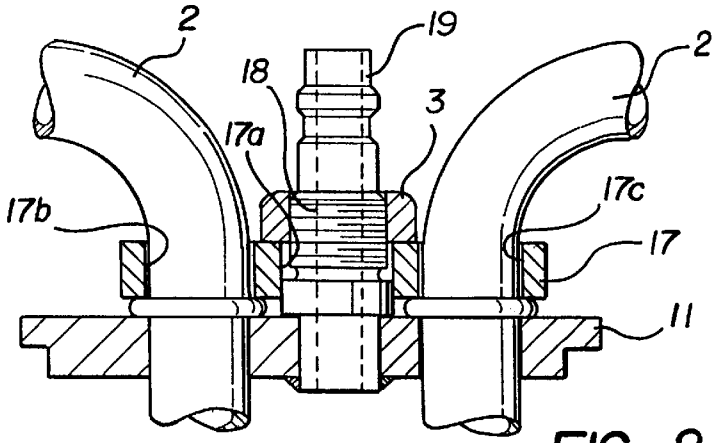
FIG. 2 is a side view of the top of the pressure vessel, the valve, the nut, the mounting block, and the inlet and outlet tubes of the pressure vessel of the present invention.
Figure 3:
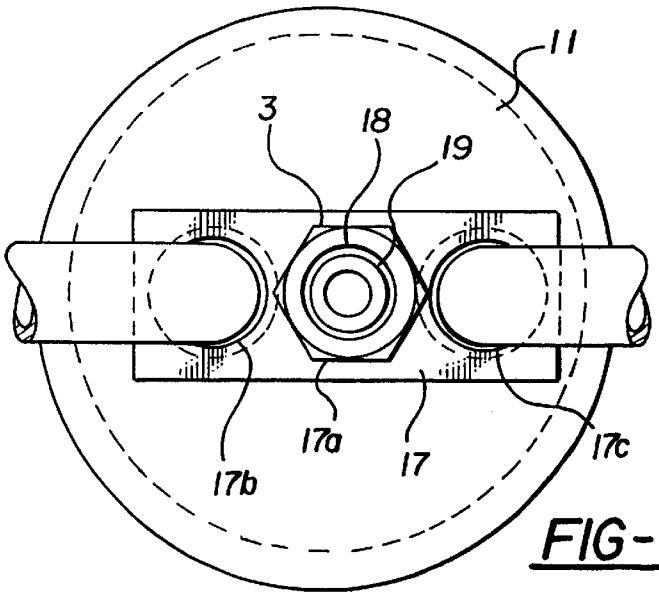
FIG. 3 is a plan view of the pressure vessel top, the valve, the nut, the mounting block, and the inlet and outlet tubes of the present invention.

Referring now to FIGS. 2 and 3, a valve 19, or other vessel accessory, may be either permanently or removably attached to the top 11. The valve 19 has an externally threaded stem portion 18 that extends beyond the top 11 to outside of the pressure vessel (not shown). Further, a mounting block 17 is located on the top I 1 and effectively traps the tubes 2 between the mounting block 17 and the top 11 using two openings 17*b* and 17*c*. The valve 19 extends through an opening 17*a* in the mounting block 17. The openings 17*a*/17*b*/17*c* of the mounting block 17 align with the holes 13/14/15 of the top. The mounting block 17 is fastened to the top 11 by a nut 3 that is securely engaged to the externally threaded stem portion 18 of the valve. One skilled in the art will recognize that any alternative means to fasten the valve 19 to the mounting block 17 may be used, such as a circlip, integral locking features, or other well known retention method.

Figure 7:
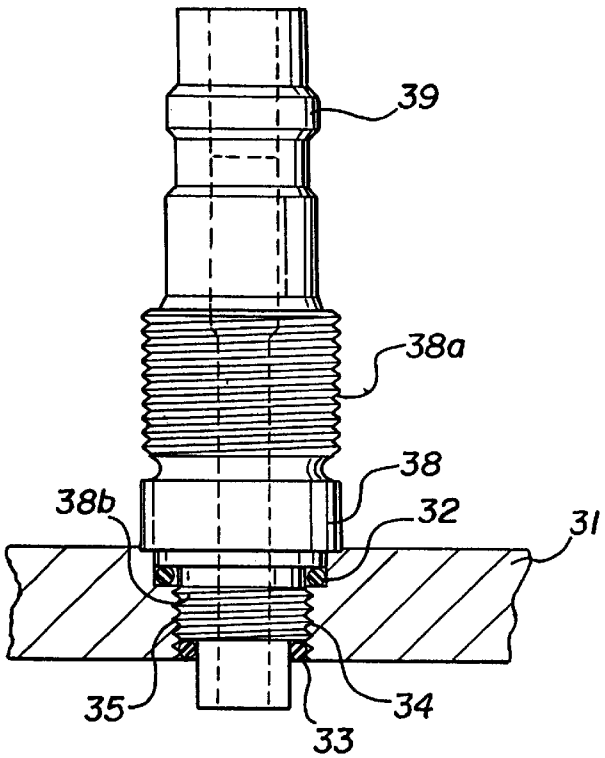
FIG. 7 is a side view shown in partial cross section of a further embodiment of the top and valve of the present invention, wherein the valve is removably attached to the top and sealed in radial and axial directions using O-rings.

In general, there are several methods that may be used for permanently attaching the valve 19 to the top 11 of the present invention. FIG. 4 illustrates an example of how permanent attachment can be accomplished by welding or brazing the valve 19 to the top 11. Alternatively the valve 19 can be machined as part of the top 11 (not shown). An alternative in which the valve is removably attached to the top is best shown in the embodiment of FIG. 7 wherein a valve 39 is shown secured to a top 31 using a threaded connection. Internal threads 34 are provided on a mounting hole 35 of the top 31. Additionally, external lower threads 38*b* are provided on the portion of a valve stem 38 that communicates with the internal threads 34 of the mounting hole 35. The connection may be sealed by including one or more O-rings 32 and 33 strategically placed radially and axially around a portion of the valve stem 38 in direct communication with the top 31. The first O-ring 32 is sandwiched between the upper region of the external lower threads 38*b* of the valve 39 and the top 31. The second O-ring 33 is sandwiched between the valve 39 and the top 31, below the external lower threads 38*b*. Finally, external upper threads 38*a* on the valve 39 communicate with a nut (not shown) located over the valve 39 and above the top 31.

FIGS. 5 and 6 show another embodiment of a pressure vessel top 21 of the present invention having more than one access port. A plurality of valves 29*a* and 29*b* are part of the top 21. In a pressure vessel having more than one valve, more than one mounting block 27*a* and 27*b* may be used, but is not necessary. Multiple valves on the vessel's top 21 can be accommodated by one mounting block (not shown).

The valves 29*a*/29*b* increase the functionality of the pressure vessel without the necessity of adding unwanted additional access openings to the housing 12. Many pressure vessels utilize pressure switches, sight glasses, charging devices, and other accessories, instead of or in addition to the valves 29*a*/29*b*. The present invention provides a ready and continuous passage for such accessories without additional openings to the interior of the vessel. For example, FIGS. 5 and 6 demonstrate a pressure switch 4 attached to a valve 29*a* of the present invention.

Figure 8:
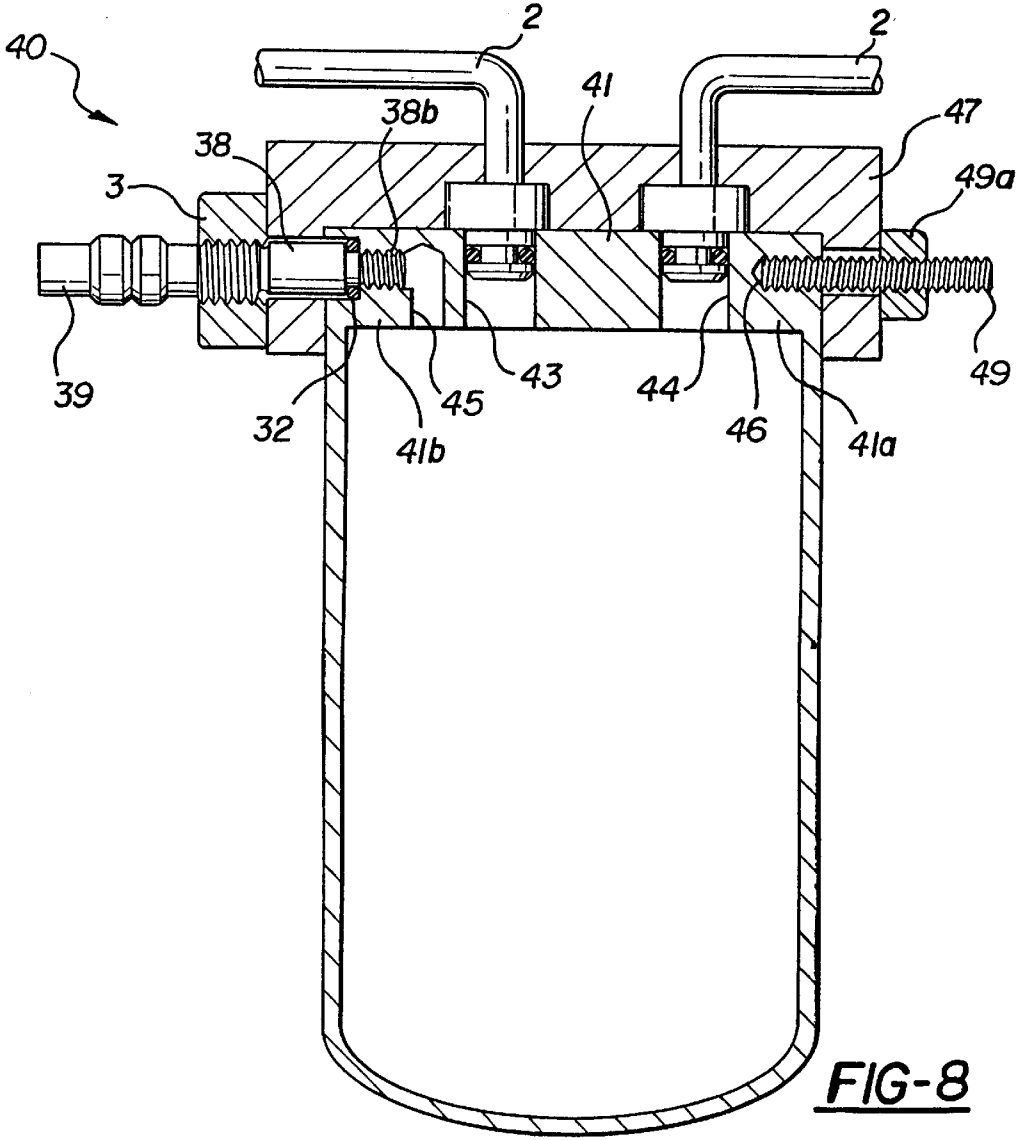
FIG. 8 is a side view, shown in partial cross section, of an embodiment of a pressure vessel of the present invention wherein the mounting block is attached at the sides of the pressure vessel.

The preferred embodiment of the present invention, as shown in FIG. 8, provides another structure for mounting a mounting block 47. FIG. 8 shows a pressure vessel 40 having a top end 41. The top end 41 has two sides 41*a* and 41*b* opposite one another, an inlet opening 43, and an outlet opening 44. The side 41*b* of the pressure vessel has an opening 45 for receiving the valve 39 of the present invention. The side 41*a* also has an opening 46 for receiving a stud 49 or other fastening member. A combination of both the valve 39 and the nut 3 on one side and the stud 49 and a nut 49*a* on the other can be used. Other configurations, such as a valve on either side (not shown), are also contemplated.

Figure 9:
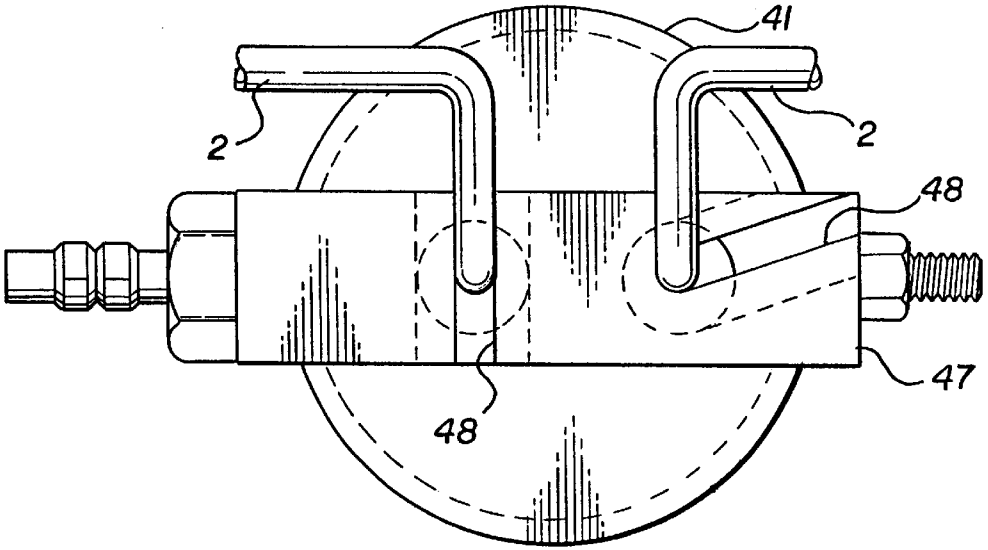
FIG. 9 is a top view of the mounting block of the embodiment shown in FIG. 8.

Furthermore, the openings 45 and 46 are used to hold the mounting block 47 on the top end 41. The external lower threads 38*b* of the stem 38 are received in the opening 45 and the O-ring 32 is used to seal the connection. The valve 39 is held to the mounting block 47 by the nut 3 that is secured over the external upper threads 38*a*. The valve 39 and nut 3 and the stud 49 and nut 49*a* hold the mounting block 47 to the vessel, while the mounting block 47 secures the inlet and outlet tubes 2 to the pressure vessel 40. Slots 48 in the mounting block 47 provide means to position the mounting block 47 over the tubes 2 and prevent the mounting block 47 from rotating on the top end 41 as shown in FIG. 9.

Figure 10:
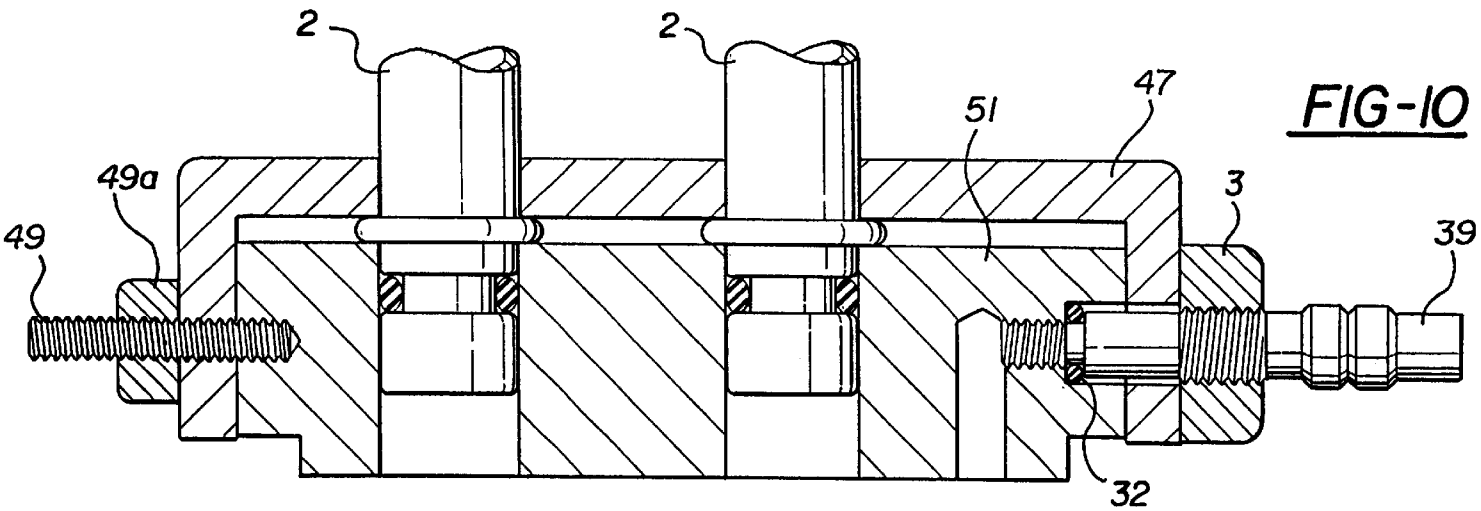
FIG. 10 is a side view shown in partial cross section of a pressure vessel top having the mounting block of the present invention attached to the sides of the vessel's top.

Referring now to the embodiment shown in FIG. 10, the mounting block 47 is shown with the inlet and outlet tubes 2 in place. FIG. 10 also shows the stud 49 and nut 49*a* and the valve 39 and nut 3 securing the mounting block 47 to a top 51 that is a separate piece from the pressure vessel housing (not shown). The valve 39 is sealed by the O-ring 32 to the top 51.

Figure 11:
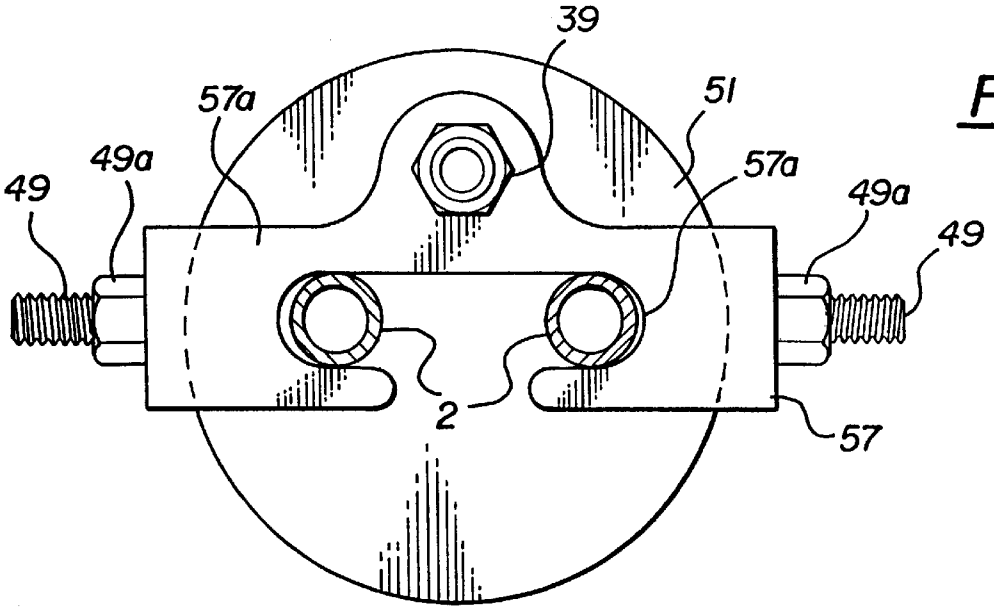
FIG. 11 is a top view of the mounting block having a configuration that is attached to the sides of the pressure vessel top using studs and nuts and to the top using a fastening valve.

Yet another embodiment is shown in FIG. 11 by a top view wherein the valve 39 is incorporated on the top 51 and additional side attachments are made using the stud 49 and nut 49*a* arrangement. A side attached mounting block 57 has a slotted portion 57*a* that receives the tubes 2 and prevents the mounting block 57 from rotating on the vessel's top 51.

Figure 12:
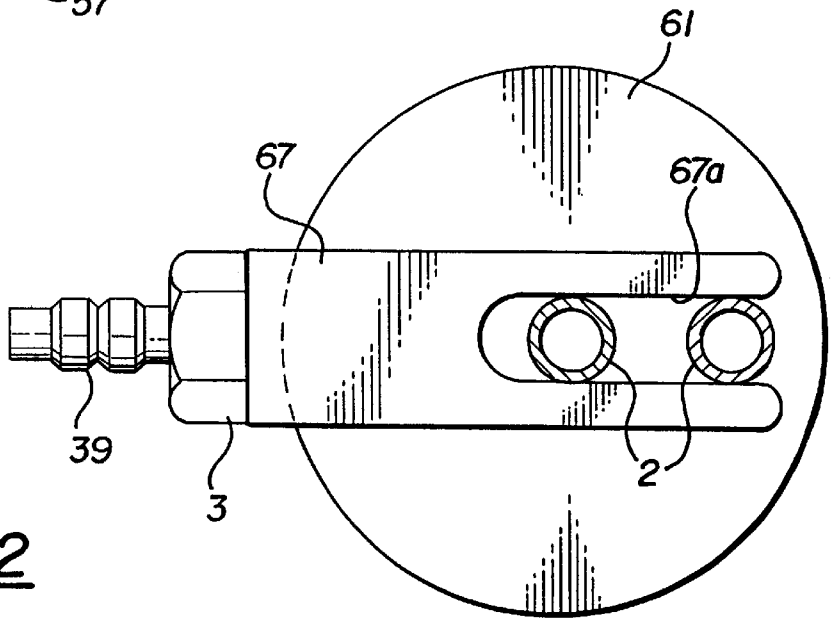
FIG. 12 is a top view of another embodiment of a top and mounting block of the present invention wherein a valve is incorporated into one side of the vessel's top and accommodated by the mounting block.

Finally, FIG. 12 is an embodiment of a mounting block 67 having a different slotted portion 67*a* for holding the tubes 2 and preventing rotation of the mounting block 67. The valve 39 and the nut 3 secure the mounting block 67 to a top 61.

An advantage of the present invention is that the valve provides communication through the top to the interior of the vessel housing and has an additional function of providing fastening means for the mounting block. The valve mount system of the present invention eliminates the need for the additional mounting hardware that is normally required in a pressure vessel assembly, such as a stud and nut system. As a result, the present invention is lighter and less expensive than conventional pressure vessel assemblies.

An additional advantage of the valve assembly of the present invention is the elimination of a braze joint that is normally required at the inlet and outlet holes. The present invention is more reliable as a result, the potential for leaks that is normally a problem with braze joints is eliminated, and a reduction in manufacturing costs by elimination of the brazing step is realized.

Although particular embodiments of the present invention have been illustrated in the accompanying drawings and described in the foregoing detailed description, it is to be understood that the present invention is not to be limited to just the embodiments disclosed. Rearrangements, modifications, and substitutions are possible, without departing from the scope of the claims hereafter.

What is claimed is:

1. A pressure vessel comprising:

a housing having an interior and a top, said top having a mounting passage therethrough;

a mounting block mounted to said top of said housing, said mounting block having a passage therethrough and aligned with said mounting passage of said top of said housing;

an accessory device extended through said passage of said mounting block and mounted to said top of said housing within said mounting passage, said accessory device having an externally threaded stem portion extending beyond said mounting block; and a nut threadably engaged to said externally threaded stem portion of said accessory device, whereby said mounting block is detachably secured between said top of said housing and said nut.

2. The pressure vessel as claimed in claim 1 wherein said accessory device comprises a valve.

3. A pressure vessel comprising:

a housing having a top, said top having a top surface, said top surface having an inlet hole and an outlet hole therein, said top further having mounting holes in opposite sides of said top;

a mounting block removably mounted external to said top, said mounting block having a pair of openings aligned with said inlet and outlet holes of said top, said mounting block further having a pair of passages aligned with said mounting holes of said top; and means for attaching said mounting block to said top of said housing, said means for attaching located in each of said mounting holes of said top extending through said pair of passages of said mounting block, said means for attaching having a threaded stem portion extending beyond said mounting block; and a nut threadably engaged to said threaded stem portion of said means for attaching, said mounting block being detachably secured to said top by said nut.

4. A pressure vessel as claimed in claim 3 wherein said means for attaching further comprises at least one valve.

5. A pressure vessel as claimed in claim 3 wherein said top surface of said top has at least one opening, said mounting block positioned over said top surface of said top, said mounting block having a third opening aligned with said at least one opening of said top surface of said top and further having:

a valve mounted to said top through said at least one opening of said top surface, said valve having a threaded stem portion extending upward from said top through said third opening of and beyond said mounting block; and a nut threadably engaged to said threaded stem portion of said valve above said mounting block for securing said mounting block to said top.

6. A pressure vessel comprising:

a housing having an interior and a top, said top having an inlet hole, an outlet hole, and at least one mounting hole therein;

at least one valve mounted to said top of said housing through said at least one mounting hole, said at least one valve having an externally threaded stem portion extending externally of said housing;

a mounting block mounted to said top externally of said housing, said mounting block having a pair of openings aligned with said inlet and outlet holes of said top for securing a pair of tubes, said mounting block having an opening aligned with said at least one mounting hole of said top, said opening of said mounting block surrounding said externally threaded stem portion of said at least one valve, said externally threaded stem portion of said at least one valve extending beyond said mounting block externally of said housing; and a nut threadably engaged to said externally threaded stem portion of said at least one valve extending beyond said mounting block, whereby said mounting block is detachably secured to said at least one valve between said top of said housing and said nut, said at least one valve providing communication with said interior of said housing.

7. A pressure vessel as claimed in claim 1 wherein said pair of openings in said mounting block aligned with said inlet and outlet holes are slotted to prevent said mounting block from rotating.

8. The pressure vessel as claimed in claim 1 wherein said at least one valve is welded to said housing.

9. The pressure vessel as claimed in claim 1 wherein said at least one valve is brazed t o said housing.

10. The pressure vessel as claimed in claim 1 wherein said at least one valve is machined as part o f said housing.

11. The pressure vessel as claimed in claim 1 wherein said at least one mounting hole of said housing further includes internal threads, wherein said externally threaded stem portion of said at least one valve is threadably engaged with said at least one mounting hole.

12. The pressure vessel as claimed in claim 11 further comprising at least one O-ring sealingly engaged between said at least one mounting hole and said externally threaded stem portion of said at least one valve.

13. The pressure vessel as claimed in claim 11 further comprising a first O-ring axially sealing said externally threaded stem portion of said at least one valve and a second O-ring radially sealing said externally threaded stem portion of said at least one valve.

* * * * *

UNITED STATES PATENT AND TRADEMARK OFFICE

CERTIFICATE OF CORRECTION

PATENT NO. : 6,308,736 B1
DATED : October 30, 2001
INVENTOR(S) : Lafer et al.

It is certified that error appears in the above-identified patent and that said Letters Patent is hereby corrected as shown below:

Column 4,
Line 4, first occurrence, delete “I 1” before the period “.” and insert -- 11 --.
Line 4, second occurrence, delete “1 1” before “has an inlet” and insert -- 11 --.
Line 6, delete “1 2a” after “interior” and insert -- 12a --.
Line 6, delete “I 1” before “and effectively” and insert -- 11 --.
Line 17, delete “t o” after “brazed” and insert -- to --.

Signed and Sealed this

Twenty-sixth Day of November, 2002

*Attest:*

*Attesting Officer*

JAMES E. ROGAN
*Director of the United States Patent and Trademark Office*